US006935842B2

(12) United States Patent
Tai

(10) Patent No.: US 6,935,842 B2
(45) Date of Patent: Aug. 30, 2005

(54) CEILING FAN BLADE MOUNTING ASSEMBLY FOR CEILING FAN

(76) Inventor: Chun Ya Tai, 9F., No. 92, Jing-Cheng Rd., Taichung City (TW)

( * ) Notice: Subject to any disclaimer, the term of this patent is extended or adjusted under 35 U.S.C. 154(b) by 20 days.

(21) Appl. No.: 10/729,484

(22) Filed: Dec. 5, 2003

(65) Prior Publication Data

US 2005/0123403 A1 Jun. 9, 2005

(51) Int. Cl.[7] ..... F04D 29/34
(52) U.S. Cl. ..... 416/210 R; 416/206
(58) Field of Search ..... 416/210 R, 206

(56) References Cited

U.S. PATENT DOCUMENTS 6,241,476 B1 * 6/2001 Lee ..... 416/210 R
6,309,183 B1 * 10/2001 Bucher et al. ..... 416/210 R
6,652,236 B2 * 11/2003 Hai ..... 416/206

* cited by examiner

*Primary Examiner*—Ninh H. Nguyen
(74) *Attorney, Agent, or Firm*—Charles E. Baxley

(57) ABSTRACT

The present invention relates to a ceiling fan blade assembly, including: a mounting bracket has a positioning portion and a mounting portion, and an arm being disposed between the positioning portion and the mounting portion for connecting them together, the positioning portion is fixed to a ceiling fan's base body; plural fixing elements are secured on the mounting portion of the mounting bracket, one of the plural fixing elements located close to a position where the mounting portion and the arm are connected; an elastic plate has protrusive latch hooks which located in symmetric manner, the elastic plate is fixed by the fixing elements and located close to the position where the arm and the mounting portion are connected, and two wing portions of each elastic plate are located at both sides of the arm of the mounting bracket; a ceiling fan blade is provided at an end thereof with plural holes, the holes each have a gap, and the gap of the respective holes being directed in the same direction.

2 Claims, 7 Drawing Sheets

CEILING FAN BLADE MOUNTING ASSEMBLY FOR CEILING FAN

BACKGROUND OF THE INVENTION

1. Field of the Invention

The present invention relates to ceiling fan, and more particularly to ceiling fan blade mounting assembly.

2. Description of the Prior Arts

Referring to FIGS. 1 and 2, a conventional ceiling fan blade mounting assembly for ceiling fan generally includes mounting bracket 10 and blade 20. The mounting bracket 10 has a positioning portion 11 and a mounting portion 12, and an arm 13 is disposed between the positioning portion 11 and the mounting portion 12 for connecting them together. The positioning portion 11 is fixed to a base body of a ceiling fan, on the mounting portion 12 is provided with three joints 14, and each of the joints 14 has a head portion 141 and a rod portion 142, an elastic plate 15 is located close to the arm 13. The blade 20 is defined at an end thereof with three holes 21, and each of the holes 20 is further defined with a gap 22, the gap 22 of the holes 20 is directed to the same direction. Such that the respective holes 21 of the blade 20 can be aligned with the joints 14 of the mounting bracket 10, so as to make the head portion 141 of the joints 14 locate at an upper surface of the blade 20, and the rod portion 142 locate in the holes 21. And then pull the blade 20 in opposite direction to the mounting bracket 10, so as to make the rod portion 142 of the joints 14 engage in the gap 22, meanwhile, the elastic plate 15 is used to prevent disengagement of the blade 20 form the mounting bracket 10. However, in real operation, there are still some defects need to be improved:

First, after the blade 20 is mounted on the mounting bracket 10, the rod portion 142 of the joints 14 abuts against the bottom 221 of the gap 21 of the holes 22. In the meantime, a latch hook 151 of the elastic plate 15 abuts against a lower surface of the blade 20, since the mounting bracket 10 and the blade 20 rotate cyclically, and the gap 22 of the respective holes 21 are directed along the long side of the blade 20, a side 222 of the gap 22 and the rod portion 142 of the joints will apply forces to each other because of inertia, and the forces caused between the side 222 of the gap 22 and the rod portion 142 of the joints 14 will be the greatest just when the ceiling fan starts. In other words, the rod portion 142 of the joints 14 will abut against a side of the gap 20, but not abuts against the bottom 221 of the gap 22. After long time of usage, there will be gap appear between the rod portion 142 of the joints 14 and the gap 22, meanwhile, the elastic plate 51 is susceptible to swing up and down due to being pressed by the rod portion 142 of the joints 14, and thus, after a certain period, the latch hook 151 is unable to securely press against the lower surface of the blade 20 because of elastic fatigue. As a result, the rod portion 142 of the joints will probably be disengaged from the holes 21 of the blade 20, which will further lead to a sever problem of the disengagement of the blade 20 from the mounting bracket 10.

Second, noise is one of the main problems that most designers want to solve, the elastic plate 15 is used to reinforce the engagement between the mounting bracket 10 and the blade 20, since the elastic plate 15 only has one latch hook 151, there will be space appear between the latch hook 151 of the elastic plate 15 and the blade due to elastic fatigue or bad registration, and thus it will cause noise.

The present invention has arisen to mitigate and/or obviate the afore-described disadvantages of the conventional ceiling fan blade mounting assembly.

SUMMARY OF THE INVENTION

The primary object of the present invention is to provide a ceiling fan blade mounting assembly capable of preventing disengagement of the ceiling fan blade from mounting bracket during the rotation of the ceiling fan.

The secondary object of the present invention is to provide a ceiling fan blade mounting assembly capable of reducing the noise cause by the ceiling fan during operation.

In accordance with one aspect of the present invention, there is provided with a ceiling fan blade assembly, including: a mounting bracket has a positioning portion and a mounting portion, and an arm being disposed between the positioning portion and the mounting portion for connecting them together, the positioning portion is fixed to a ceiling fan's base body; plural fixing elements are secured on the mounting portion of the mounting bracket, one of the plural fixing elements located close to a position where the mounting portion and the arm are connected; an elastic plate has protrusive latch hooks located in symmetric manner, the elastic plate is fixed by the fixing elements and located close to the position where the arm and the mounting portion are connected, and two wing portions of each elastic plate are located at both sides of the arm of the mounting bracket; a ceiling fan blade is provided at an end thereof with plural holes, the holes each have a gap, and the gap of the respective holes are directed in the same direction.

The present invention will become more obvious from the following description when taken in connection with the accompanying drawings, which shows, for purpose of illustrations only, the preferred embodiment in accordance with the present invention.

DETAILED DESCRIPTION OF THE PREFERRED EMBODIMENTS

Figure 1:
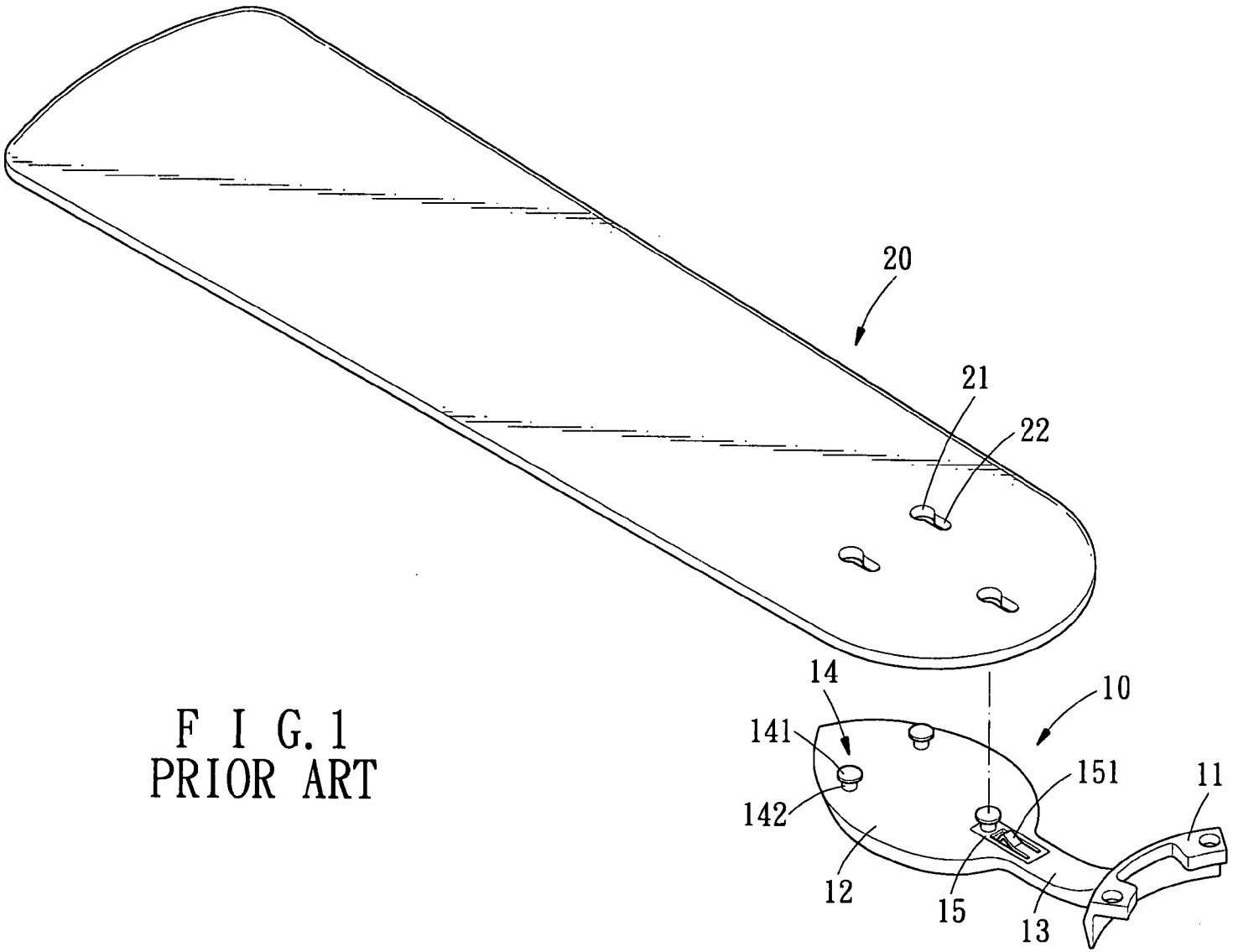
FIG.1 PRIOR ART
FIG. 1 is an exploded view of a conventional ceiling fan blade mounting assembly.
Figure 2:
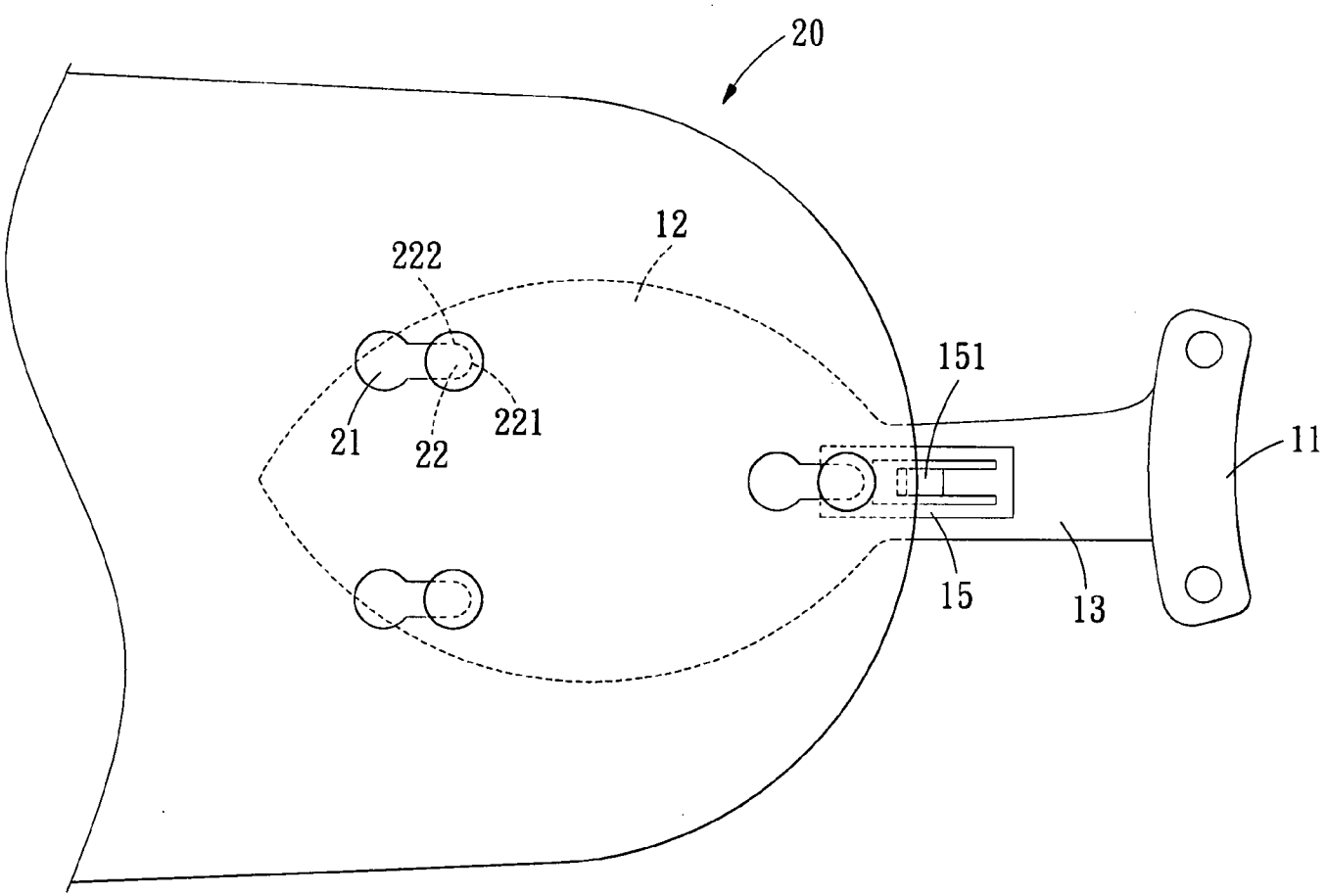
FIG. 2 PRIOR ART
FIG. 2 is a top assembly view of a conventional ceiling fan blade mounting assembly.
Figure 3:
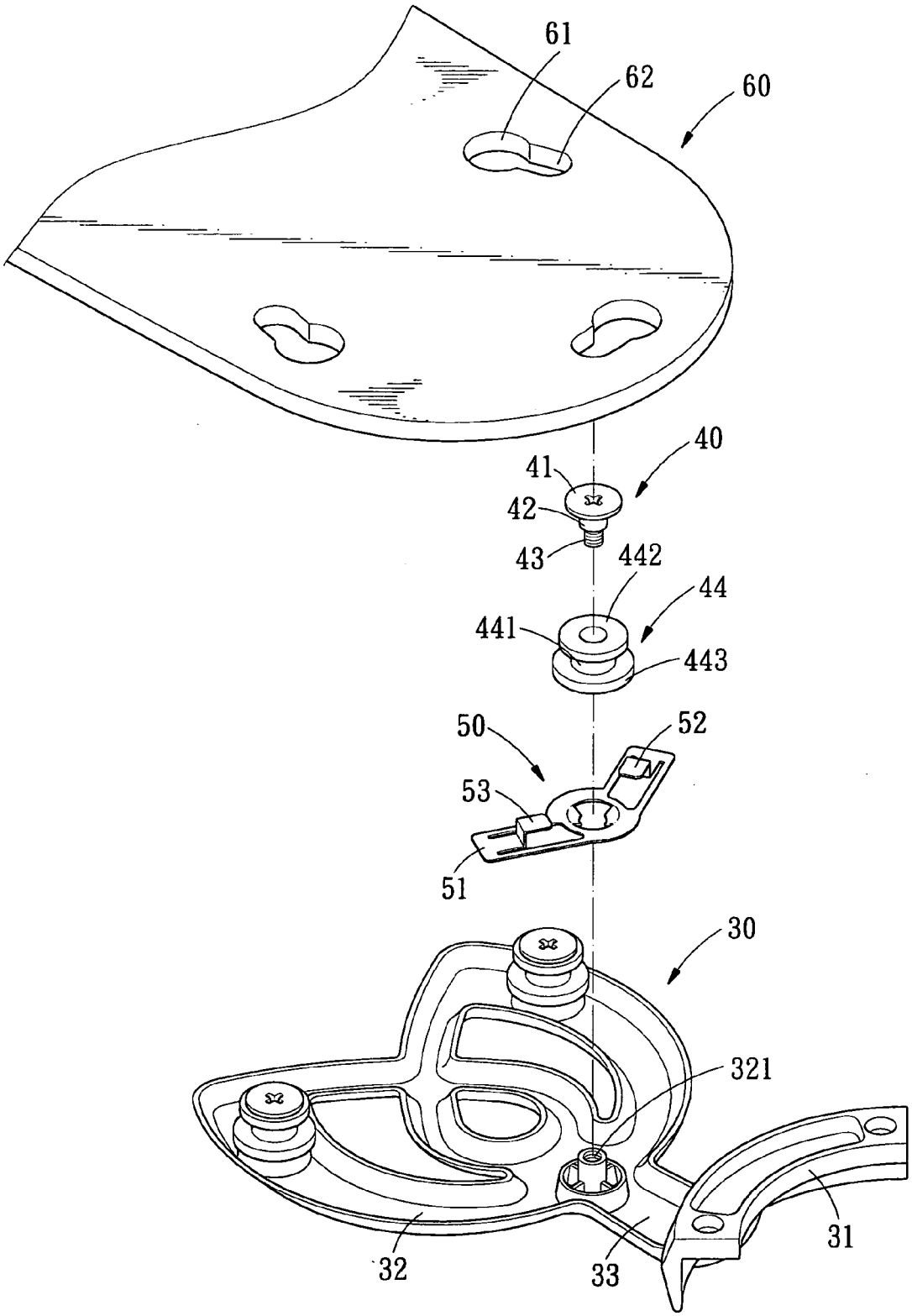
FIG. 3 is an exploded view of a ceiling fan blade mounting assembly in accordance with the present invention.
Figure 4:
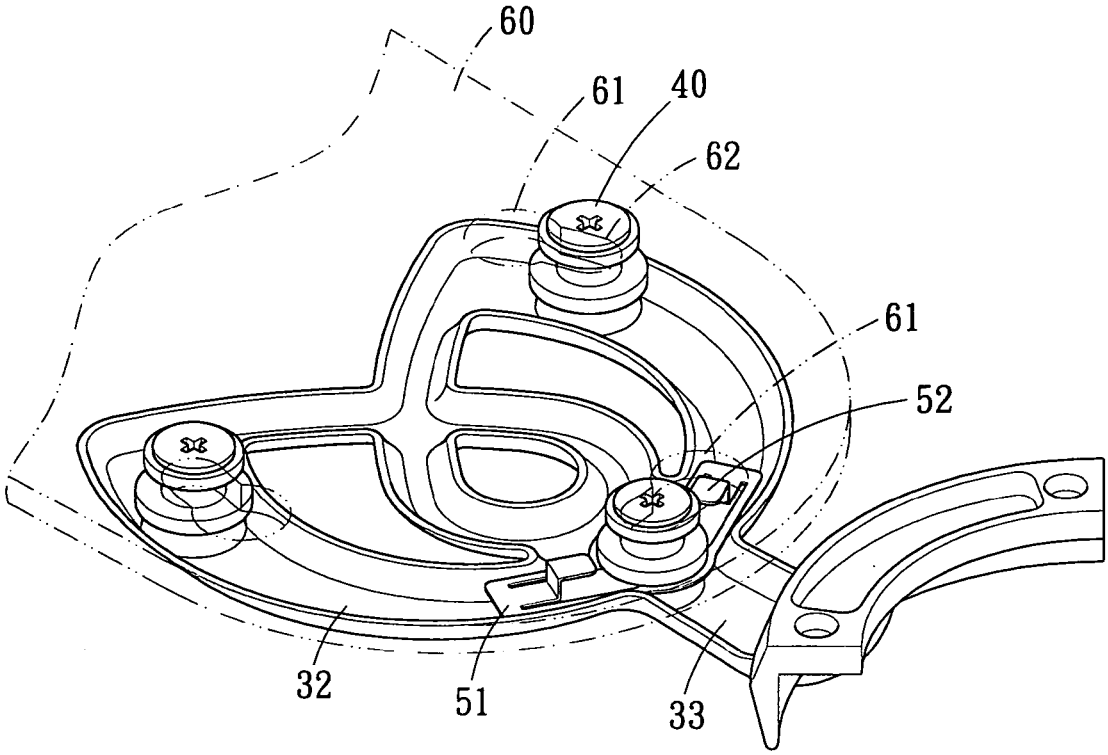
FIG. 4 is an assembly view of the ceiling fan blade mounting assembly in accordance with the present invention.

Referring to FIGS. 3 and 4, a ceiling fan blade mounting assembly generally comprises a mounting bracket 30, three fixing elements 40, an elastic plate 50 and a ceiling fan blade 60.

The mounting bracket 30 has a positioning portion 31 and a mounting portion 32, and an arm 33 is disposed between the positioning portion 31 and the mounting portion 32 for connecting them together. Wherein the positioning portion 31 is fixed to a ceiling fan's base body, whereas the mounting portion 32 is defined on an upper surface thereof with three threaded holes 321. One of the three threaded holes 321 is located close to the position where the arm 33 and the mounting portion 32 are connected.

The three fixing elements 40 each have a head portion 41 and a rod portion 42. The rod portion 42 extends downward and is provided with a threaded section 43 to be screwed in the threaded holes 32 of the mounting bracket 30. Furthermore, a soft washer 44 is mounted onto the rod portion 42 of the respective fixing elements 40. The washer 44 has an engaging portion 441, and an upper portion 442 and a lower portion 443 are respectively formed at both sides of the engaging portion 441. The head portion 41 of the fixing elements 40 stops the upper portion 442.

The elastic plate 50, from the center outward, plural wing portions 51 are extended in symmetric manner, and the respective wing portions 51 tilt a little upward. Furthermore, the wing portions 51 each are folded upward to form a first latch hook 52 and a second latch hook 53. The elastic plate 50 is fixed by the fixing elements 40 and located close to the position where the arm 33 and the mounting portion 32 are connected, and pressed by the lower portion 443 of the washer 44. The two wing portions 51 of each elastic plate 50 are located at both sides of the arm 33 of the mounting bracket 30.

The ceiling fan blade 60 is provided at an end thereof with three is holes 61, the holes 61 each have a gap 62, and the respective holes 62 are directed in the same direction. The fixing elements 40 are inserted in the corresponding holes 61 and then rotated at angle, so as to be positioned in the corresponding gap 62. In the meantime, the first latch hook 52 of the elastic plate 50 abuts against the hole 61 of the ceiling fan blade 60, 20 whereas a lower surface of the ceiling fan blade 60 presses against the second latch hook 53. By such arrangements, the ceiling fan blade 60 can be securely mounted on the mounting bracket 30.

Figure 5:
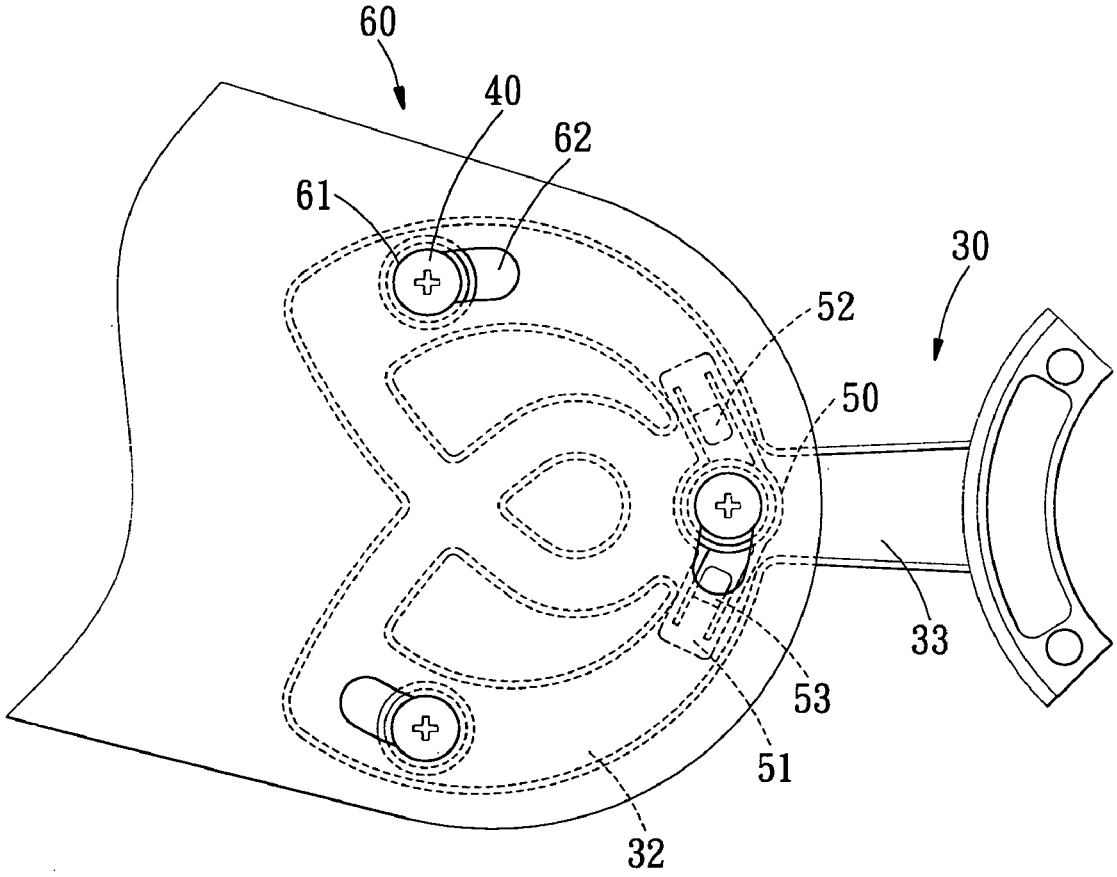
FIG. 5 is an illustrative view, which shows the ceiling fan blade mounting assembly of the present invention before assembly.
Figure 6:
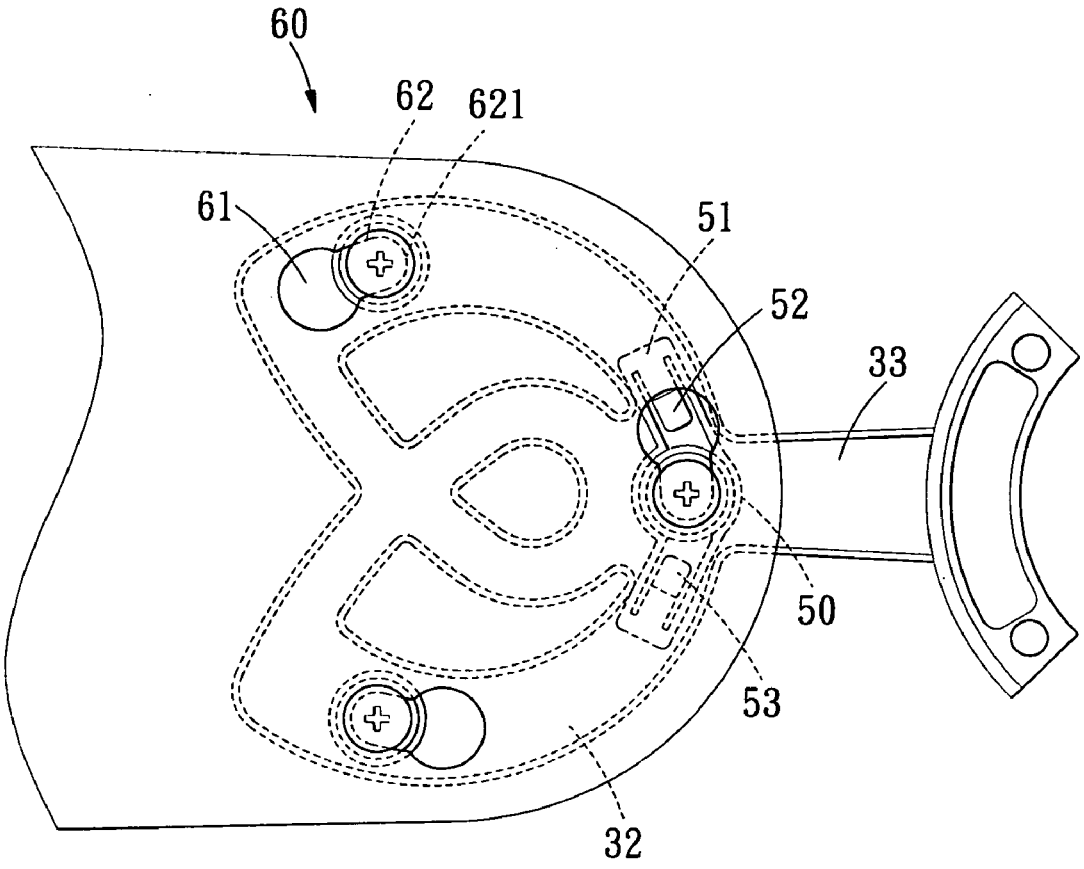
FIG. 6 is an illustrative view, which shows the ceiling fan blade mounting assembly of the present invention after assembly.
Figure 7:
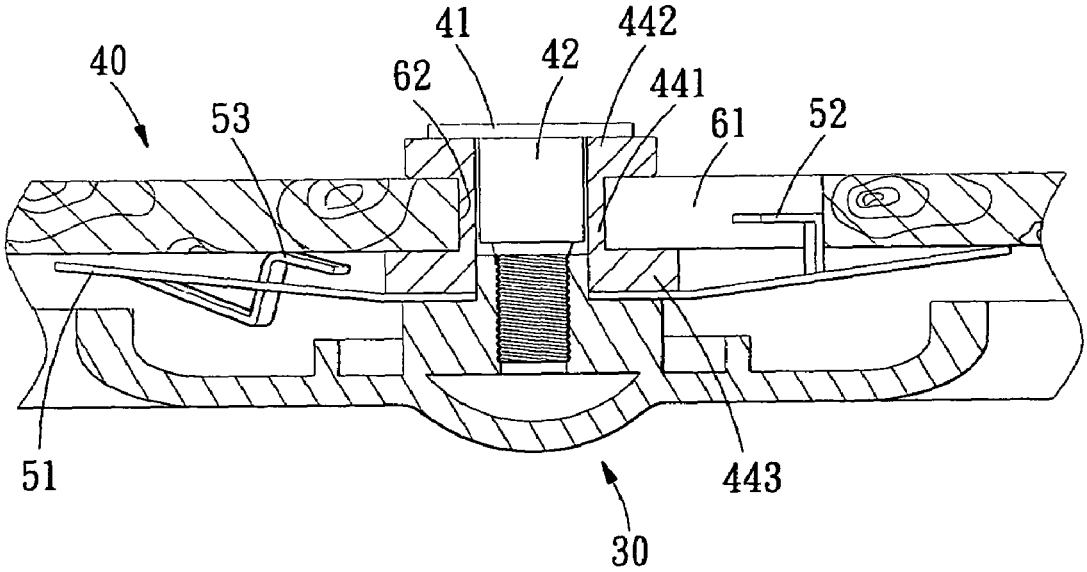
FIG. 7 is a partial cross sectional view of the ceiling fan blade mounting assembly of the present invention.

Referring further to FIGS. 5–7, in order to mount the ceiling fan blade 60 onto the mounting bracket 30, the respective holes 61 of the ceiling fan blade 60 should be initially aligned with the fixing elements 40 of the mounting bracket 30, and make the head portion 41 of the fixing elements 40 and the upper portion 442 of the washer 44 locate at an upper surface of the ceiling fan blade 60, whereas the rod portion 42 of the fixing elements 40 and the engaging portion 441 of the washer 44 are located in the holes 61. And then rotate the ceiling fan blade 60 in counterclockwise relative to the mounting bracket 30, so as to engage the rod portion 42 of the respective fixing elements 40 and the engaging portion 441 of the washer 44 in the gap 62. In the meantime, the first latch hook 52 of the elastic plate 50 abuts closely against the hole 61 of the ceiling fan blade 60, whereas a lower surface of the ceiling fan blade 60 presses against the second latch hook 53. By such arrangements, the ceiling fan blade 60 can be securely mounted on the mounting bracket 30.

In addition, since the gap 62 of the respective holes 61 are directed in the same direction, during the rotation of the mounting bracket 30 and the ceiling fan blade 60, the rod portion 42 of the fixing elements 40 and the engaging portion 441 of the washer 44 will be pushed against a bottom 621 of the gap 62 because of inertia. Meanwhile, the elastic plate 50 securely abuts against the inner surface of the respective holes 61 of the ceiling fan blade 60, the rod portion 42 of the fixing elements 40 and the engaging portion 441 of the washer 44 can be prevented from moving into the hole 61 from the gap 62, such that the ceiling fan blade 60 is securely positioned.

It will be noted that the respective holes 61 of the ceiling fan blade 60 can be aligned with the fixing elements 40 and then the fixing elements 40 can be engaged in the gap 62 after an angle of rotation. In the meantime, the first latch hook 52 of the elastic plate 50 abuts closely against the inner surface of the hole 61 of the ceiling fan blade 60, whereas the lower surface of the ceiling fan blade 60 presses against the second latch hook 53. Such that the elastic plate 50 just acts like an arm so as to make the first latch hook 52 securely engage in the hole 61, in this way, the ceiling fan blade 60 can be securely mounted on the mounting bracket 30. Furthermore, since the ceiling fan blade 60 is securely mounted on the mounting bracket 30, the noise can be reduced.

Three fixing elements 40 each have a head portion 41 and a rod portion 42. The rod portion 42 extends downward and is provided with a threaded section 43 to be screwed in the threaded holes 32 of the mounting bracket 30. Furthermore, a soft washer 44 is mounted onto the rod portion 42 of the respective fixing elements 40. The washer 44 has an engaging portion 441, and an upper portion 442 and a lower portion 443 are respectively formed at both sides of the engaging portion 441. The head portion 41 of the fixing elements 40 stops the upper portion 442.

While we have shown and described various embodiments in accordance with the present invention, it should be clear to those skilled in the art that further embodiments may be made without departing from the scope of the present invention.

What is claimed is:

1. A ceiling fan blade mounting assembly comprising: a mounting bracket having a positioning portion and a mounting portion, and an arm disposed between the positioning portion and the mounting portion for connecting them together, the positioning portion fixed to a ceiling fan's base body;

plural fixing elements secured on the mounting portion of the mounting bracket, one of the plural fixing elements located close to a position where the mounting portion and the arm are connected;

an elastic plate having protrusive latch hooks which are located in a symmetrical manner, the elastic plate fixed by the one fixing element and located close to the position where the arm and the mounting portion are connected, and two wing portions of the elastic plate located at both sides of the arm of the mounting bracket;

a ceiling fan blade provided at an end thereof with plural holes, the holes each having a gap, and the gaps of the respective holes directed in the same direction;

wherein the respective holes are aligned with the fixing elements, and then after an angle of rotation, the respective fixing elements occupy the gaps of the respective holes, such that the latch hook at a wing end of the elastic plate engaging the hole of the one fixing element, and a lower surface of the ceiling blade pressing against the latch hook at another wing end of the elastic plate.

2. The ceiling fan blade mounting assembly as claimed in claim 1, wherein the respective fixing elements are provided with a washer.

* * * * *